US005590524A

United States Patent [19]

Moore, III et al.

[11] Patent Number: 5,590,524

[45] Date of Patent: *Jan. 7, 1997

[54] DAMPED HEAT SHIELD

[75] Inventors: Dan T. Moore, III, Cleveland Heights; Austin W. Moore, Shaker Heights; Maurice E. Wheeler, Ashtabula, all of Ohio

[73] Assignee: Soundwich, Inc., Cleveland, Ohio

[ * ] Notice: The portion of the term of this patent subsequent to Aug. 10, 2010, has been disclaimed.

[21] Appl. No.: 258,962

[22] Filed: Jun. 13, 1994

Related U.S. Application Data

[63] Continuation-in-part of Ser. No. 102,158, Aug. 4, 1993, Pat. No. 5,347,810, which is a continuation of Ser. No. 883,279, May 14, 1992, Pat. No. 5,233,832.

[51] Int. Cl.[6] ..... F01N 7/10

[52] U.S. Cl. ..... 60/323; 60/272; 60/299; 181/240; 181/263

[58] Field of Search ..... 60/299, 323, 272; 181/263, 240

[56] References Cited

U.S. PATENT DOCUMENTS

| | | |
|---|---|---|
| 3,133,612 | 5/1964 | Sailler . |
| 3,237,716 | 3/1966 | Parsons . |
| 3,413,803 | 12/1968 | Rosenlund et al. . |
| 3,505,028 | 4/1970 | Douthit . |
| 3,863,445 | 2/1975 | Heath . |
| 3,908,372 | 9/1975 | Fowler et al. . |
| 3,963,087 | 6/1976 | Grosseau . |
| 4,022,019 | 5/1977 | Garcea . |
| 4,085,816 | 4/1978 | Amagai et al. . |
| 4,118,543 | 10/1978 | Donohue . |
| 4,142,605 | 3/1979 | Bosch . |
| 4,194,484 | 3/1980 | Kirchweger ete al. . |
| 4,308,093 | 12/1981 | Bodendorf et al. . |
| 4,432,433 | 2/1984 | Ogawa . |
| 4,433,542 | 2/1984 | Shimura . |
| 4,487,289 | 12/1984 | Kicinski ..... 181/263 |
| 4,612,767 | 9/1986 | Engquist et al. . |
| 4,678,707 | 7/1987 | Shinozaki et al. . |
| 4,709,781 | 12/1987 | Scherzer . |
| 4,851,271 | 7/1989 | Moore, III et al. . |
| 4,914,912 | 4/1990 | Akatsuka . |
| 4,930,678 | 6/1990 | Cyb . |
| 4,972,674 | 11/1990 | Yamada et al. . |
| 5,167,060 | 12/1992 | Nawrockl et al. . |
| 5,233,832 | 8/1993 | Moore, III . |

OTHER PUBLICATIONS

*Fiberfrax Ceramic Fiber Paper* brochure, The Carborundum Company, (1990), pp. 1–3.

*Primary Examiner*—Douglas Hart

*Attorney, Agent, or Firm*—Pearne, Gordon, McCoy & Granger

[57] ABSTRACT

A damped heat shield for a high temperature portion of a vehicle exhaust system. The heat shield has inner and outer metal layers of substantially different thicknesses and substantially different resonant frequencies, which causes the shield to damp vibrational energy and reduce radiated sound energy and noise. Between the metal layers is a layer of sound and heat shielding material such as aluminum foil or ceramic fiber paper. The metal layers are preferably stainless steel, cold rolled steel, aluminized steel, aluminum-clad steel, or aluminum. If cold rolled steel is used, the exterior of the shield is preferably coated with a corrosion-resistant coating.

43 Claims, 3 Drawing Sheets

DAMPED HEAT SHIELD

This is a continuation-in-part of application Ser. No. 08/102,158, filed Aug. 4, 1993, now U.S. Pat. No. 5,347,810, which was a continuation of application Ser. No. 07/883,279, filed May 14, 1992, now U.S. Pat. No. 5,233,832. The content of both of these is incorporated herein by reference.

BACKGROUND OF THE INVENTION

This invention relates generally to shields, such as heat shields, and more particularly, to a novel and improved damped heat shield.

DESCRIPTION OF RELATED ART

Heat shields are often used adjacent to the exhaust manifold of an internal combustion engine in a vehicle such as a passenger automobile. Such shields are useful to prevent damaging heat from reaching the adjacent components in the vehicle engine compartment. Such heat shields are typically formed of a single metal layer of corrosion-resistant metal, such as aluminized steel, which is die-formed to conform generally to the manifold shape while providing an air space between the manifold and the shield. Since a typical manifold heat shield is formed of a single sheet of metal, the shield does not function as an efficient sound energy-absorbing or damped structure, particularly when the engine vibrations applied to the shield approach resonant frequency of the shield.

It is also known to provide a heat shield for an exhaust manifold formed of two metal layers of corrosion-resistant aluminized sheets of equal thickness. Such heat shields tend to improve resistance to heat transmission for a given material weight and also improve the damping of the heat shield. It is believed that in the Fall of 1992 General Motors Corporation began selling in the United States automobiles with exhaust manifold heat shields, said heat shields being two layers of aluminized steel, one layer being 0.024 inches thick and the other layer being 0.017 inches thick; these heat shields not having a third layer of material between the two aluminized steel layers. For such things as an oil pan, it is known to laminate two metallic layers on opposite sides of a polymeric or viscoelastic inner layer to provide damping. U.S. Pat. Nos. 4,678,707 and 4,851,271 describe such systems. In these systems, the inner layer is bonded to the outer metal layers. U.S. Pat. No. 4,914,912, the contents of which are incorporated by reference, discloses an exhaust manifold heat shield with an insulating layer sandwiched between an inner layer and an outer layer.

SUMMARY OF THE INVENTION

The present invention provides a novel and improved damped heat shield. The illustrated embodiment is an exhaust manifold heat shield. However, the invention is applicable to other shielding applications where the shield must combine high temperature heat shielding with efficient vibration damping. Illustratively, the heat shield may shield other portions of the exhaust system such as the exhaust pipe, the catalytic converter, and the muffler.

An illustrated embodiment provides two very thin metal layers of steel having different thicknesses positioned on opposite sides of a sheet of non-ferrous metal. The two steel layers are formed of uncoated material which, in its initial state, does not have good corrosion resistance. After the three layers are formed to the desired shape, at least some edges are hemmed to maintain the layers in nested substantial abutting contact.

The assembly is then coated with a high temperature corrosion-resistant coating that not only provides corrosion resistance to the exposed surface of the shield, but also forms a seal between the layers along the edges of the shield. Although the inner surfaces of the three layers remain substantially uncoated, the entry of corrosion producing substances into the interior of the shield is prevented by the high temperature coating. Consequently, significant corrosion of the interior surfaces of the shield does not occur.

Damping and vibration absorption is improved by utilizing sheets of thin steel having different thicknesses for the inner and outer metal layers. Because the two layers have the same shape but different thicknesses, they have mismatched resonant frequencies. When the frequency of vibration created by engine operation or from other sources is in resonance with one steel layer, it is not in resonance with the other steel layer. Therefore, the two layers move relative to each other. The friction resisting such relative movement results in an efficient damping and absorption of the vibrational energy resulting in the radiation of less sound energy and noise. Further, it is believed that the third layer of non-ferrous metal tends to increase the friction resisting the relative movement between the two metal sheets. This further increases the damping qualities of the shield.

The third layer intermediate the inner and outer steel layers also provides resistance to thermal transmission by increasing the number of interface surface barriers within the shield.

In an illustrated embodiment, the inner and outer metal layers are formed of a steel generally referred to as double-reduced black plate. The outer metal layer is preferably about 0.008 inches thick, while the inner metal layer is preferably about 0.006 inches thick. The intermediate or third layer of non-ferrous metal positioned between the inner and outer steel layers is preferably aluminum foil having a thickness of about 0.001 inches. Consequently, the total metallic material thickness of the shield is about 0.015 inches. This compares with prior art similar shields having a metallic thickness in the order of 0.036 inches. Consequently, the weight of the shield, in accordance with the present invention, is substantially less than comparable prior art shields.

After the shield is die-formed, it is coated with a high temperature resistant paint-like coating.

The coating is applied to the shield by a dipping or spraying operation, and thereafter, the shield is baked to cure the coating. The cured coating is about 0.001 inches thick. By using a dip-type coating, complete coverage, including the edges, is achieved. In fact, the coating provides a peripheral seal between the three layers to prevent entry of corrosion producing substances. This completes the manufacture of an illustrated embodiment of the present invention.

In another embodiment of the invention, the inner and outer metal layers can be stainless steel or aluminum-clad sheet steel or aluminized steel or other types of steel or other metal provided with corrosion protection, and the intermediate third layer can be a layer of fibrous heat shielding material, preferably ceramic fiber paper. The shield is adapted, such as via bolt holes and general conformation, to be fixed in relationship to a high temperature portion of an exhaust system, such as an exhaust manifold, so as to provide an air gap.

In another embodiment of the invention, the inner and outer metal layers can be aluminum, and the intermediate third layer can be steel.

These and other aspects of this invention are illustrated in the accompanying drawings and are more fully described in the following specification.

DETAILED DESCRIPTION OF PREFERRED EMBODIMENTS

Figure 1:
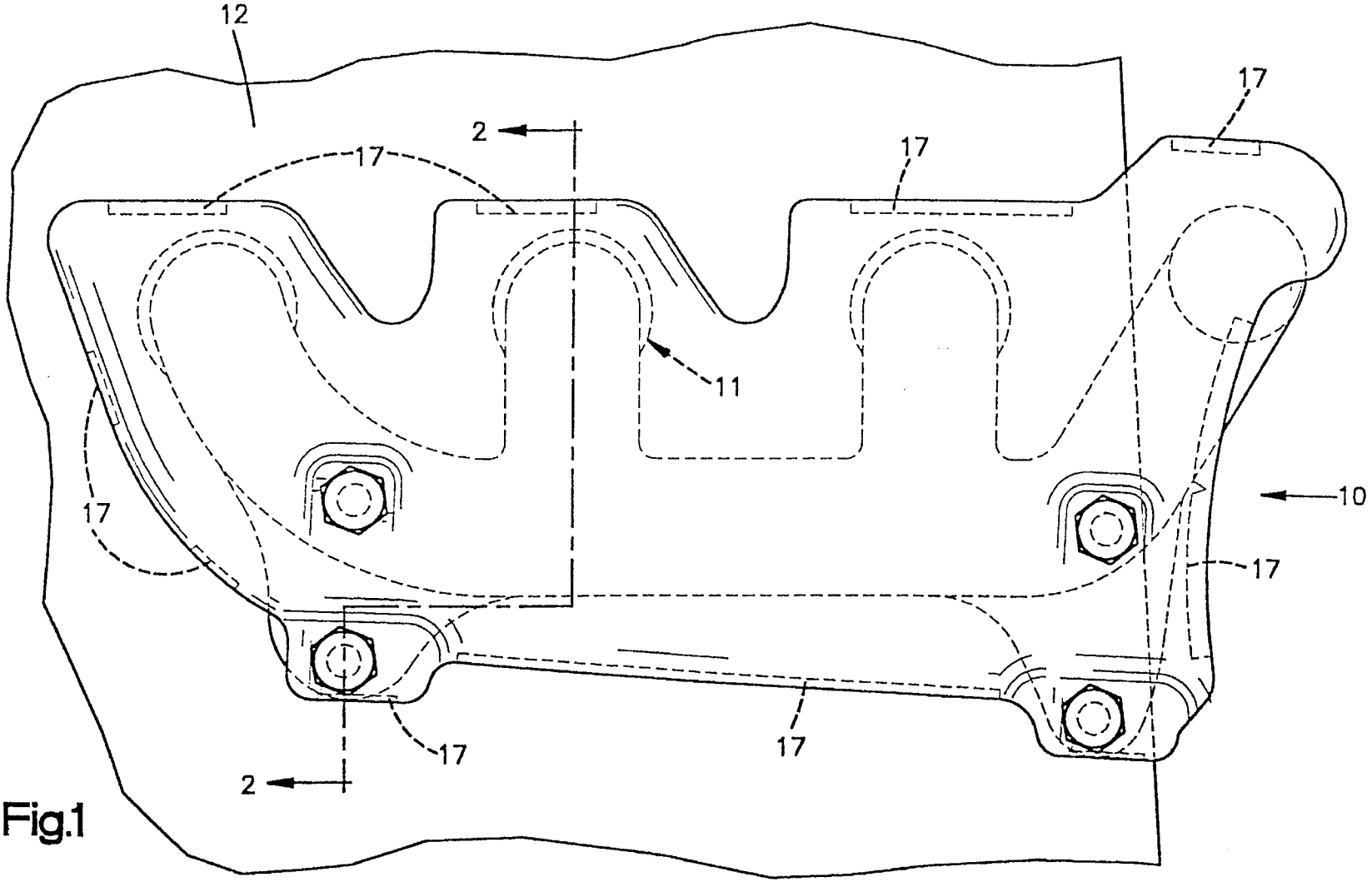
FIG. 1 is a schematic side elevation of a heat shield incorporating the present invention applied to the exhaust manifold of a vehicle internal combustion engine.
Figure 2:
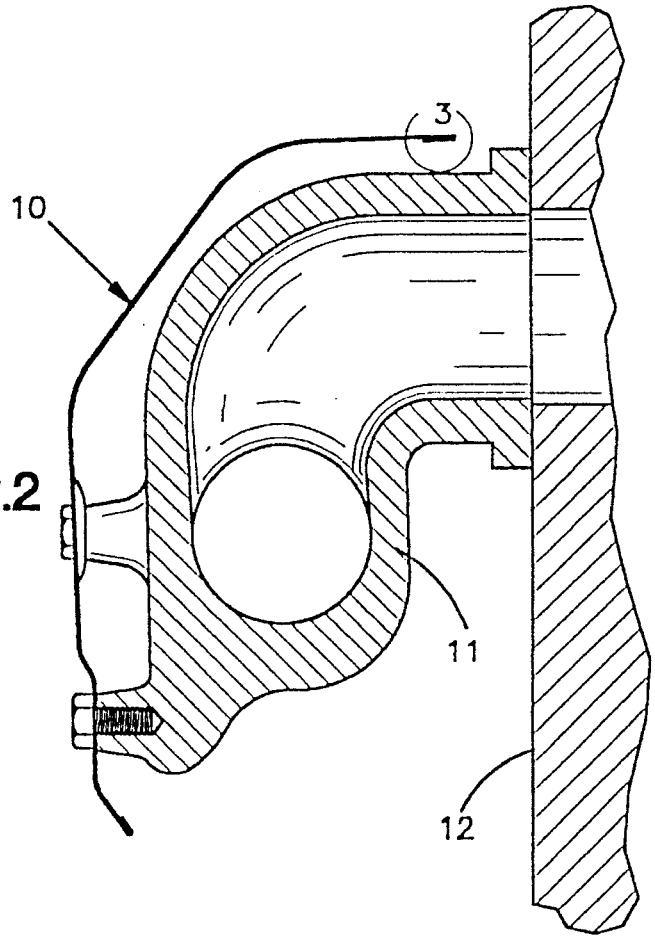
FIG. 2 is a fragmentary section taken along 2—2 of FIG. 1.

FIGS. 1 and 2 illustrate a damped heat shield 10 mounted on a schematically illustrated exhaust manifold 11 of a vehicle internal combustion engine schematically illustrated at 12. The illustrated heat shield 10 is a replacement for an existing prior art heat shield of the same configuration, but which is formed of a single layer of aluminized steel having a thickness of about 0.036 inches. Because the prior art heat shield was aluminized, it was protected against corrosion, even at the relatively high temperatures which existed in such application.

Because the exhaust manifold directly receives the exhaust gases (frequently 1550° F.) from the engine, the exterior surface of the exhaust manifold reaches extremely high temperatures (frequently 1400° F.) which are a direct function of the engine loading during operating conditions. Under extreme operating conditions, the exhaust manifold 11 can reach cherry red temperatures. Normally, however, the temperatures in the manifold, per se., are at lower levels. In any event, however, the heat shield must generally be capable of surviving exposure to such extreme temperature conditions. Preferably the heat shield can withstand a temperature of 1000° F., more preferably 1200° F. In practice, the inner surface of the heat shield generally does not exceed 1000° F. to 1200° F. because it is spaced apart from the manifold by an air gap. An air gap is illustrated in FIG. 2. The air gap is preferably about 3 to 13 mm, more preferably about 6 to 8 mm, wide, but the air gap width frequently varies due to manufacturing considerations. The heat shield preferably does not completely encircle or surround the exhaust manifold; preferably it curves around the surface of the exhaust manifold opposite the engine (see FIG. 2), partially enclosing the manifold. To minimize transmission of heat and vibrational energy from the manifold and engine to the heat shield, there is minimal physical contact between (a) the heat shield and (b) the manifold and engine. For example, the points of physical contact in FIG. 1 are the four bolts, which fix the heat shield in relationship to the exhaust manifold to provide the air gap.

The sound reductive characteristics of the prior art single layer heat shield are very poor since the single layer is incapable of significant damping of vibrational energy. Further, the single layer heat shield tends to establish a more pronounced resonance containing more energy and creating a slower sound decay.

In order to improve thermal shielding and sound damping qualities, it has been proposed to form the heat shield from two layers of aluminized steel in which each layer has a thickness of about 0.017 inches. Such thickness is the present minimum thickness of available aluminized steel and results in a two-layer heat shield of the same shape which has a total material thickness of about 0.034 inches. Consequently, the weight of such a two-layer heat shield was virtually identical to the weight of the prior art single-layered heat shields having a single layer thickness of about 0.036 inches.

Although this two-layered shield provided some improvement in damping and resistance to heat transfer, the mere fact that the two layers were relatively thick, and therefore, relatively massive, the sound damping qualities were still relatively poor. In fact, both layers having the same shape and thickness tend to have the same resonant frequency. Therefore, the tendency for the two-layer shield to resonate still existed.

In objective terms, the two-layer system radiates 10.96 times the sound as does the three-layer system of the present invention. This data was obtained by placing each of the heat shields in a semi-anechoic chamber and vibrating the exhaust manifold to which the heat shield was attached using random vibration generated from a signal analyzer through a vibration exciter. A condenser microphone monitored the A-weighted sound pressure radiating from the heat shield. The 0.008"/0.001"/0.006" steel-aluminum-steel three-layer system had a dBA level of 57.2 over the frequency range of 0–800 Hz. A 0.018"/0.018" two-layer system produced 67.6 dBA over the same frequency range. After converting Db to B (bels), the calculation is inverse log 6.76 divided by inverse log 5.72 equals 10.96.

In accordance with one embodiment of the present invention, however, the heat shield is formed of three metallic or metal layers. The inner and outer layers are very thin sheets of steel commonly referred to as black plate, preferably imperforate. In the illustrated embodiment with reference to FIGS. 3 and 4, the outer metal layer 13 is about 0.008 inches thick, and the inner metal layer 14 is also black plate steel, but is provided with a thickness of about 0.006 inches. As used herein in the specification and claims, these thicknesses are substantially different and the resonant frequencies of these layers are substantially different. Sandwiched between the outer and inner layers 13 and 14 respectively is a very thin non-ferrous metal layer 16. In the illustrated embodiment, this interior layer is preferably an aluminum foil having a thickness of about 0.001 inches, preferably imperforate, although other metal foils may be used, such as stainless steel foil and steel-nickel alloy foil.

The three layers 13, 14 and 16 are simultaneously die-formed to the required shape. Consequently, all three layers have the same configuration and extend in substantial abutting relationship. Portions of the edge of the die-formed heat shield are provided with hems 17 to permanently and tightly join the three layers along the edges thereof. These hems 17 extend along the edges, as indicated by the dotted lines, marked 17 in FIG. 1. Because of the peripheral edge shape of the shield, it is impractical to form the hems 17 along the entire edge of the shield. However, the hems are preferably provided along a substantial portion of the heat shield edges to ensure that the layers remain nested and the edges remain substantially closed.

Figure 3:
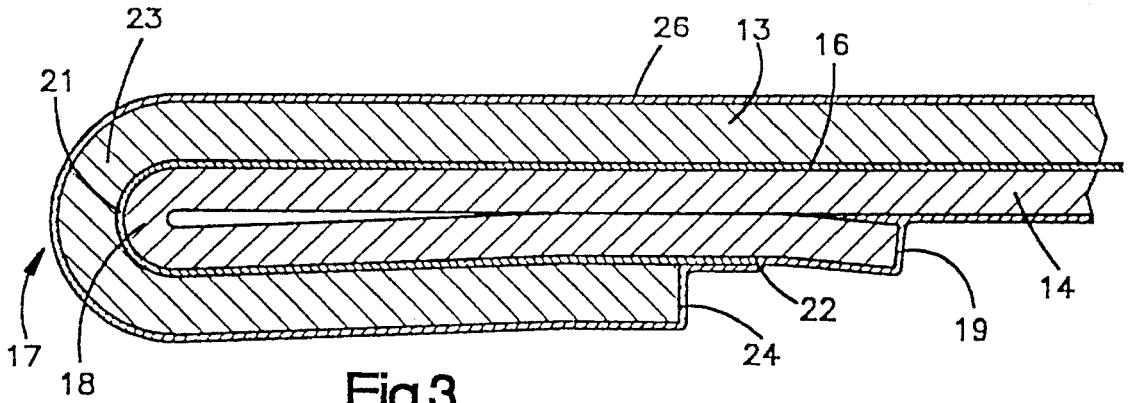
FIG. 3 is a greatly enlarged fragmentary section of the portion identified as 3 in FIG. 2 illustrating the structural detail at edge portions of the shield where a hem is formed.

FIG. 3 illustrates the hem structure 17 at greatly enlarged scale. The inner layer 14 is bent back upon itself at 18 and extends to a free end 19. Similarly, the interior aluminum layer 16 is formed with a reverse bend at 21 and extends to a free end at 22. Finally, the outer layer 13 is formed with a reverse bend at 23 and extends to a free end at 24. It should be noted that the free ends 19, 22 and 24 are offset a small distance from each other due to the fact that the interior layer 16 and the outer layer 13 must extend around the reverse bend of the inner layer 14. In FIG. 3, the three layers are illustrated in full and intimate contact for purposes of illustration. However, in reality, small air spaces of an irregular nature exist along at least portions of the interface of the layers due to variations of material spring back after the die forming operation.

During the forming operation, the three layers are fed from three supply rolls and are maintained in aligned and abutting relationship. Preferably, the three layers are spot welded or stapled along scrap edge portions to maintain a unitary assembly. Blanks, consisting of the three layers, are cut from the supply of material. Therefore, each layer has identical size, accounting for the slight offsets noticed in the hems of FIG. 3.

Figure 4:
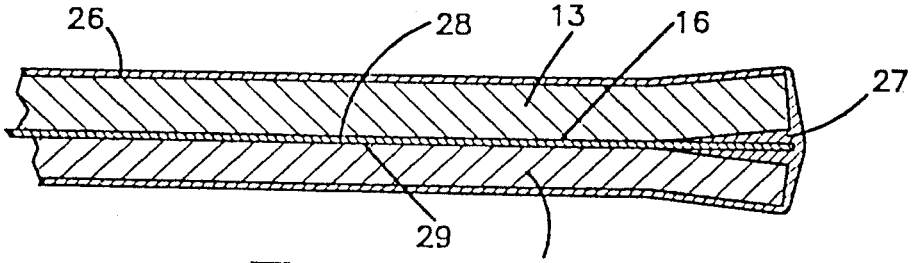
FIG. 4 is a greatly enlarged fragmentary section along an edge of a shield where a hem is not formed.

FIG. 4 illustrates an edge structure at the same scale as FIG. 3, but illustrates an edge along a zone where a hem does not exist. There is a tendency at such edge locations for a slight spreading of the edges of the three layers to exist.

After the hemming operation, the entire shield is coated along its exterior surfaces with a high temperature resistant paint-type coating. This coating 26 is applied preferably by dipping the formed and uncoated heat shield into a bath of the temperature-resistive paint coating 26. This ensures that all exterior surfaces, including the edges, are fully coated. The coating may also be applied by spraying. After removing the heat shield from the bath and allowing excess material to drip off the unit, the coated unit is allowed to dry. Then, to provide a full cure of the coating the unit is baked, for example, at about 400° F. for one hour. As best illustrated in FIG. 4, the coating material 26 penetrates into the edge zones 27 between the various layers and forms an effective seal to prevent corrosion producing substances from Penetrating into the interior zone between the various layers. Similarly, a full seal is formed along the edges of the hem, as illustrated in FIG. 3. The cured coating is about 0.001 inch thick.

With this structure, the coating is only applied to the exposed surfaces of the heat shield, and the interior surfaces of the outer and inner steel layers remain uncoated. However, since the edges are fully sealed, corrosion producing materials cannot enter into the interior of the heat shield, and corrosion does not present a problem. The fact that the interior interface 28 between the outer layer 13 and the aluminum layer 16, as well as the interface 29 between the inner layer 14 and the aluminum interior layer 16 remain uncoated, is desirable from a damping and sound-absorption standpoint, as discussed below.

The coating 26 is preferably classified as silicone high temperature aluminum heat-resistance coatings containing a silicone copolymer. Such coatings can be obtained from a number of sources, including the following: Barrier Coatings, located at 12801 Coit Road, Cleveland, Ohio 44108, under the designation "BT1200". Another suitable coating can be obtained from the Glidden Company, at 5480 Cloverleaf Parkway, Suite 5, Valley View, Ohio 44125, under their designation product number "5542". Still another source is the Sherwin Williams Company of Cleveland, Ohio, identified by their product number "1200MSF". All of such coatings have the ability to withstand temperatures of 1000° F. to 1200° F. and operate to provide good corrosion-resistant protection to the heat shield illustrated.

The two interfaces 28 and 29 function to form a barrier resisting heat transfer through the shield. Consequently, temperatures along the external surface of the heat shield, in accordance with the present invention, are lower than in the prior art comparable single layer heat shields under similar operating conditions.

The vibration damping qualities of a heat shield, in accordance with the present invention, are far superior to the vibration damping qualities of the single-layer prior art shields for several reasons. First, by forming the inner layer 14 substantially thinner than the outer layer 13, the two layers having identical shape have different resonant frequencies. Therefore, if vibration is applied to the shield approaching the resonant frequency of one of the layers 13 or 14, the other layer will not be resonant at such frequency, and relative movement will occur along the interfaces 28 and 29. Such relative movement is resisted by the friction existing along such interfaces, and the sound and vibrational energy is quickly dissipated and absorbed. This is particularly true at higher vibration frequencies. Further, the coefficient of friction between the two steel layers and the interior aluminum layer tends to be higher than would exist between two steel layers without an intermediate layer. Therefore, the relative movement between the various components creates a frictional damping of the vibrational energy in a very efficient manner.

Finally, because the mass of the three-layered shield, in accordance with the present invention, is substantially lower than the mass of the prior art units, the three-layered system does not have the capacity to store as much vibrational energy. It should be noted that the weight of a single layer prior art comparable heat shield is about 1.16 lbs., while the same heat shield formed in accordance with the present invention described above is 0.54 lbs. Consequently, a heat shield, in accordance with the present invention, reduces the heat shield weight, compared to the typical prior art units, by about 50%. Further, the cost of materials and production is slightly less with the illustrated heat shield compared to the prior art single-layered heat shield. Reductions in weight, particularly in modern vehicles, is highly desirable, since improved fuel efficiency results from decreased weight. Therefore, the fact that the present invention provides weight savings, as well as improved performance, at a reduced cost, is highly valuable.

In objective terms, the prior art single-layer system 0.036 inches thick radiates 48.98 times as much sound as does the three-layer system of the present invention. This data was obtained by placing each of the exhaust shields in a semi-anechoic chamber and vibrating the exhaust manifold to which the heat shield was attached using random vibration generated from a signal analyzer through a vibration exciter. A condenser microphone monitored the A-weighted sound pressure radiating from the heat shield. The 0.008"/0.001"/0.006" three-layer system had a DBA level of 57.2 over the frequency range of 0–800 Hz. The prior art 0.036 inches single-layer system produced 74.1 DBA over the same frequency range. After converting Db to B, the calculation is inverse log 7.41 divided by inverse log 5.72 equals 48.98.

In tests actually performed in production vehicles, it was found that the noise level, both in the engine compartment and in the passenger compartment of the vehicle, was substantially reduced with the above-described heat shield in accordance with the present invention, compared to the prior art single-layered heat shield.

To summarize the foregoing, a heat shield, in accordance with the present invention, improves the resistance to heat transfer, improves the damping of vibration thereby reducing the radiation of sound energy and noise, reduces weight, and reduces cost with respect to a comparable heat shield of the prior art.

With regard to the present invention, for the outer metal layer 13 can be substituted a stainless steel sheet, preferably 0.008 inches thick and preferably 409 stainless steel, and for the inner metal layer 14 can be substituted a stainless steel sheet, preferably 0.006 inches thick and preferably 409 stainless steel, with the interior layer 16 being aluminum foil preferably 0.001 inches thick. In this configuration of stainless steel/aluminum foil/stainless steel, it is preferably not necessary to apply a paint-type coating 26 to the exterior of the shield, since the stainless steel and aluminum foil have excellent inherent corrosion-resistant qualities.

Alternatively, in a heat shield of the present invention, the outer metal layer 13 can be stainless steel, preferably 409 stainless steel 0.008 inches thick, the inner metal layer 14 can be stainless steel, preferably 409 stainless steel 0.006 inches thick, and the interior layer 16 can be a layer of fibrous heat shielding material, preferably ceramic fiber material, more preferably ceramic fiber paper. The fibrous heat shielding material is preferably able to withstand 700° F., more preferably 1000° F., even more preferably 1200° F., without degradation or change which would significantly or materially or substantially affect its ability to effectively perform its intended function. A preferred ceramic fiber paper is Fiberfrax 440, available from The Carborundum Company, Niagara Falls, N.Y., preferably 0.070 inches thick, less preferably 0.130 inches thick (thickness being measured under 4 PSF). Fiberfrax brand ceramic fiber papers consist primarily of alumino-silicate fibers in a non-woven matrix with a latex binder system, the fibers being randomly oriented forming uniform, flexible, lightweight sheets. Fiberfrax 440 is a combination of ceramic fiber, inert filler, and reinforcing fiberglass, is recommended for use to 1300° F., has a density of 13 PCF, a chemistry (parts by weight) of 33 parts $Al_2O_3$, 45 parts $SiO_2$, 2 parts $Na_2O_3$, 2 parts $Fe_2O_3$, 18 parts others, and 9.5 parts of material, including binder, which is lost upon exposure to high temperature (i.e., burning out the organics). In this configuration of stainless steel/ceramic fiber paper/stainless steel, it is preferably not necessary to apply a paint-type coating 26 to the exterior of the shield, since the stainless steel has excellent inherent corrosion-resistant qualities and the ceramic fiber paper has excellent corrosion resistance from most corrosive agents, including salts, engine fluids, and other agents to which internal combustion engine heat shields are exposed.

Figure 5:
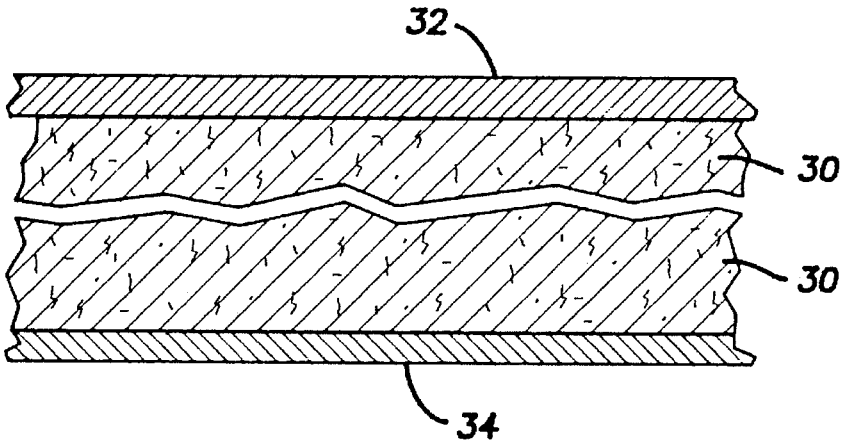
FIG. 5 is a cross-section of a portion of a heat shield having fibrous heat shielding material between two metal layers.

FIG. 5 illustrates in cross-section a portion of a heat shield having an interior layer 30 of fibrous heat shielding material, such as ceramic fiber paper, sandwiched between an outer metal layer 32 of stainless steel and an inner metal layer 34 of stainless steel. The interior layer 30 is shown as broken to illustrate the fact that the fibrous heat shielding material layer, when it is ceramic fiber paper, is preferably about 8.75 times as thick as the outer metal layer 32 of stainless steel.

Alternatively, in a heat shield of the present invention, the outer metal layer 13 can be black plate or cold rolled steel, preferably low carbon, preferably 0.008 inches thick, the inner metal layer 14 can be black plate or cold rolled steel, preferably low carbon, preferably 0.006 inches thick, and the interior layer 16 can be a layer of fibrous heat shielding material, preferably ceramic fiber material, more preferably ceramic fiber paper, as described above. In this configuration of black plate steel/ceramic fiber paper/black plate steel, it is preferable to apply the paint-type coating 26 to the exterior of the shield as previously described, due to the susceptibility of such steel to corrosive attack.

Alternatively, the outer metal layers 13 and 32 and the inner metal layers 14 and 34 can be aluminum-clad steel or aluminized steel or other types of steel with an aluminum or other type surface providing corrosion protection, and "metal layer" and "metal layers", as used in the specification and claims, includes all these materials. The term "steel" includes stainless steel. Aluminum-clad steel is where a thin aluminum sheet is clad or bonded to a thicker steel sheet by mechanical pressure or other bonding means; preferably the aluminum sheet is clad to only one side of the steel sheet (the side facing the exterior when incorporated into the heat shield, where corrosion is more likely), but steel clad on both sides with aluminum is also possible. Aluminized steel is generally produced by contacting liquid aluminum on a solid, steel surface such as sheet steel. For example, sheet steel may be dipped in an aluminum bath, typically coating both sides. It is also believed that vacuum deposition aluminum-coated steel may be used. Vacuum deposition aluminum-coated steel is produced by a process also referred to as vacuum metalizing or aluminum vapor deposition, where aluminum is vaporized, typically by applying an electric arc current to aluminum wire, and the vaporized aluminum is deposited as a thin coat or film on a relatively cool sheet steel substrate in close proximity, in a vacuum environment. Preferably only one side of the sheet steel substrate is coated with a thin coating or film of aluminum (the side to face the exterior when incorporated in the heat shield), but the steel may also be coated on both sides. When steel which is already protected with aluminum is used for the outer metal layers 13 and 32 and the inner metal layers 14 and 34, it is generally not necessary to utilize the paint-type coating 26.

Alternatively, the outer metal layer 13 can be aluminum, preferably 0.010–0.012, more preferably 0.010, inches thick, the inner metal layer 14 can be aluminum, preferably 0.007–0.009, more preferably 0.008, inches thick, and the interior layer 16 can be steel, preferably cold rolled steel, preferably 0.006–0.008, more preferably 0.006, inches thick. One reason for the thickness of the interior steel layer is to provide rigidity, due to the less-rigid nature of aluminum. One advantage of this configuration is that aluminum is a softer metal and will wrinkle less in a stamping operation. Alternatively, the interior layer 16 can be a layer of fibrous heat shielding material, the outer metal layer 13 can be aluminum, preferably 0.020 inches thick, and the inner metal layer 14 can be aluminum, preferably 0.016 inches thick. If the inner metal layer 14 is going to experience temperatures at or above 1100° F., it is generally preferable to make it of stainless steel or other type of temperature and corrosion-resistant steel, rather than aluminum, due to the fact aluminum may begin to soften or deform at 1100° F.

Figure 6:
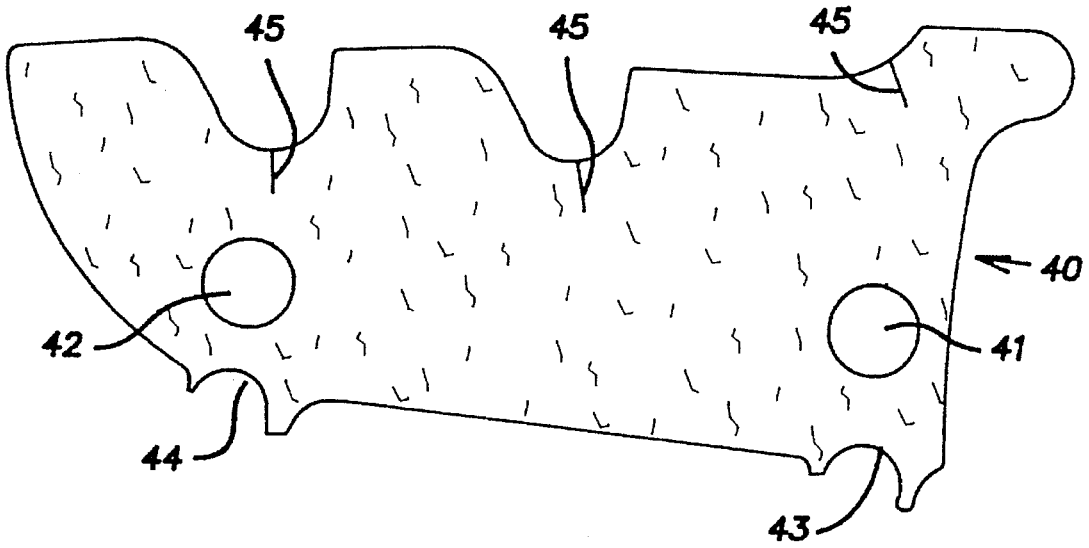
FIG. 6 is a plan view of a piece of ceramic fiber paper for use in a heat shield of the present invention.

To form a heat shield having an interior layer of fibrous heat shielding material such as ceramic fiber paper, it is preferable to die cut the ceramic fiber paper into blanks such as illustrated in FIG. 6, cut the steel or metal blanks, place the ceramic fiber paper blank between the two steel or metal sheets, spot weld the assembly to hold it together, and run the 3-layer assembly through a series of dies to form the heat shield and the hems. With reference to FIG. 6 (not to scale but roughly with reference to the heat shield of FIG. 1), there is a ceramic fiber paper blank 40 having cut-outs 41 and 42 where material has been cut out where two of the bolts (see FIG. 1) which attach the shield to the manifold or engine will go through the shield. There are also semi-circular indents 43 and 44 where material has been cut away where the other two bolts of FIG. 1 will pass through the plane of the ceramic fiber paper blank. The cut-outs and indents are large enough so that the ceramic fiber paper blank will not interfere with the drawing and forming of metal in that immediate vicinity, and the ceramic blank will not be torn. Slits 45 have preferably been cut in the blank at places where the blank may be torn in the subsequent stamping operation. The ceramic blank is preferably cut so that the peripheral or perimeter edge of the ceramic blank will be about ¼ to ½ inches back from the peripheral or perimeter edge of the two steel or metal blanks. If the ceramic fiber paper blank extended to the edge of the metal blanks, the ceramic fiber paper blank could be clamped in the hem 17 and torn, or stick out from the heat shield, which is unsightly and could more easily absorb moisture. Each spot weld is preferably placed on the flat metal surface immediately next to the bolt hole, avoiding the ceramic fiber paper blank and minimizing vibration and heat transmission. Preferably two or three spot welds are used per heat shield.

Testing has shown the acoustic and thermal benefits of a heat shield having an inner and outer layer of different thicknesses over a heat shield having a single layer, and the further benefits when a third interior layer is placed between the inner and outer layers of different thicknesses.

With regard to sound reduction potential, material coupons of the various one, two, and three layer composite types were constructed in a Giger plate configuration. An 8"×8" coupon or plate was mounted in a fixture that clamped all four edges. The entire fixture was excited in the direction perpendicular to the coupon or plate with a vibration table. The input force to the fixture assembly was measured as well as the response of the plate with a non-contact magnetic induction transducer. The frequency of the resonances of the plate was measured and the two frequencies to the left and right of the resonance peak that were 3 dB below this resonance frequency peak were also measured. The loss factor is a dimensionless number that is a measure of the damping capability of the composite type and was calculated as the difference between the two 3 dB frequencies, divided by the peak resonance frequency. A higher loss factor equates to higher damping and therefore will provide higher noise reduction. The test results, conducted at room temperature, as follows. Low carbon cold rolled steel is referred to as CRS. Material Coupon A of CRS/aluminum/CRS, the thicknesses being 0.008"/0.001"/0.006" respectively, the CRS being coated on the outside with a high temperature corrosion-resistant coating such as paint-type coating 26, had a loss factor at 1500 Hz of 0.052 and a loss factor at 2500 Hz of 0.062. Material Coupon B of stainless steel/aluminum/stainless steel, thicknesses being 0.008"/0.001"/0.006" respectively, had a loss factor at 1500 Hz of 0.042 and a loss factor at 2500 Hz of 0.054. Material Coupon C (the same as Material Coupon A except the interior layer was not aluminum but was 0.070 inch ceramic fiber paper) had loss factors at 1500 Hz and 2500 Hz of 0.033 and 0.040 respectively. Material Coupon D (the same as Material Coupon B except the interior layer was 0.070 inch ceramic fiber paper) had loss factors at 1500 Hz and 2500 Hz of 0.030 and 0.038 respectively. Material Coupon E (the same as Material Coupon A except without the interior layer of aluminum) had loss factors at 1500 Hz and 2500 Hz of 0.028 and 0.033 respectively. Material Coupon F (the same as Material Coupon B except without the interior layer of aluminum) had loss factors at 1500 Hz end 2500 Hz of 0.019 and 0.025 respectively. Material Coupon G, a single layer of 0.036 inch aluminized steel, had loss factors at 1500 Hz and 2500 Hz of 0.003 and 0.002 respectively.

With regard to heat or thermal reduction potential, material coupons were made as described above. The coupons were bent to an approximately four to five inch diameter half cylinder (looking like half a cylinder cut lengthwise) and placed above a 1100° F. one-sided heat source similarly shaped (simulating heat from exhaust manifold), there being an air gap of about 10 mm between the two surfaces. The temperature of the source and the surface temperature of the coupon on the side of the coupon away from the heat source were measured after allowing the system to stabilize. A higher temperature drop equates to better heat shielding. The test results are as follows, Material Coupons A–G being the same as described above.

| Material Coupon | Source Temperature (deg. F.) | Coupon Temperature (deg. F.) | Percent Temperature Reduction |
|---|---|---|---|
| A | 1100 | 572 | 48.0% |
| B | 1100 | 584 | 46.9% |
| C | 1100 | 565 | 48.6% |
| D | 1100 | 570 | 48.2% |
| E | 1100 | 595 | 45.9% |
| F | 1100 | 605 | 45.0% |
| G | 1100 | 660 | 40.0% |

With regard to the present invention, there is an interior layer, such as interior layer 16 or interior layer 30, which is a layer of sound and heat shielding material. A layer of sound and heat shielding material is preferably a layer of aluminum foil or a layer of fibrous heat shielding material, although other sound and heat shielding materials are known in the art. The layer of fibrous heat shielding material is preferably ceramic fiber material, more preferably ceramic fiber paper, although fiberglass may also be used in certain applications, preferably where the temperatures are less than 800° F. Preferably the layer of sound and heat shielding material is corrosion resistant to salt, moisture, and engine fluids, and can withstand a temperature of 700° F., more preferably 1000° F., even more preferably 1200° F. Typically, organic polymeric materials cannot withstand these temperatures without melting, degrading or decomposing.

Although the preferred embodiment of this invention has been shown and described, it should be understood that various modifications and rearrangements of the parts may be resorted to without departing from the scope of the invention as disclosed and claimed herein.

What is claimed is:

1. A damped heat shield for an exhaust system of an internal combustion engine, comprising two metal layers shaped to conform generally to the shape of a high temperature portion of said exhaust system while being spaced away therefrom by an air gap, said metal layers having substantially the same shape and extending in face-to-face adjacency, a layer of sound and heat shielding material positioned between said two metal layers, one of said metal layers having a first predetermined thickness and having a first resonant frequency, the other of said metal layers having a second predetermined thickness substantially different from said first predetermined thickness and having a second resonant frequency substantially different from said first resonant frequency causing said shield to damp vibrational energy, said shield being adapted to be fixed in relationship to said high temperature portion so as to provide said air gap.

2. A heat shield according to claim 1, wherein said sound and heat shielding material is aluminum.

3. A heat shield according to claim 2, wherein each of said two metal layers is stainless steel.

4. A heat shield according to claim 3, wherein one of said stainless steel metal layers is about 0.008 inch thick, the other of said stainless steel metal layers is about 0.006 inch thick, and said layer of aluminum is about 0.001 inch thick.

5. A heat shield according to claim 2, wherein each of said two metal layers is aluminized steel or aluminum-clad steel.

6. A heat shield according to claim 5, wherein said first predetermined thickness is about 0.008 inch, said second predetermined thickness is about 0.006 inch, and said layer of aluminum is about 0.001 inch thick.

7. A heat shield according to claim 1, wherein said sound and heat shielding material is ceramic fiber material.

8. A heat shield according to claim 7, wherein each of said two metal layers is stainless steel.

9. A heat shield according to claim 8, wherein one of said stainless steel metal layers is about 0.008 inch thick, the other of said stainless steel metal layers is about 0.006 inch thick, and said ceramic fiber material is ceramic fiber paper.

10. A heat shield according to claim 7, wherein each of said two metal layers is aluminized steel or aluminum-clad steel.

11. A heat shield according to claim 10, wherein said first predetermined thickness is about 0.008 inch, said second predetermined thickness is about 0.006 inch, and said ceramic fiber material is ceramic fiber paper.

12. A heat shield according to claim 7, wherein each of said two metal layers is cold rolled steel and a high temperature paint-like corrosion-resistant coating protects the exterior surfaces of said heat shield.

13. A heat shield according to claim 12, wherein said first predetermined thickness is about 0.008 inch, said second predetermined thickness is about 0.006 inch, and said ceramic fiber material is ceramic fiber paper.

14. A heat shield according to claim 1, wherein each of said two metal layers is aluminum, and said layer of sound and heat shielding material is steel.

15. A heat shield according to claim 1, wherein one of said two metal layers is steel and is adapted to be adjacent to said high temperature portion of said exhaust system, and the other of said two metal layers is aluminum.

16. A heat shield according to claim 1, wherein said high temperature portion of said exhaust system is an exhaust manifold.

17. A heat shield according to claim 1, wherein said high temperature portion of said exhaust system is selected from the group consisting of a catalytic converter, a muffler, and an exhaust pipe.

18. A heat shield according to claim 1, said sound and heat shielding material being capable of withstanding 1200° F. without significant degradation.

19. A heat shield according to claim 7, said ceramic fiber material being capable of withstanding 1200° F. without significant degradation.

20. A heat shield according to claim 1, wherein said first predetermined thickness is at least about one and one-third times said second predetermined thickness.

21. A heat shield according to claim 1, wherein the thinner of said two metal layers is adapted to be adjacent to said high temperature portion of said exhaust system.

22. A heat shield according to claim 1, wherein hems are provided along at least some edges of said heat shield of maintain said metal layers nested together.

23. A heat shield according to claim 1, wherein said internal combustion engine is mounted in a passenger automobile.

24. A heat shield according to claim 1, wherein a significant portion of said air gap is between about 3 mm and about 13 mm wide.

25. A heat shield according to claim 1, said heat shield being adapted to be fixed in position by fixing means consisting of bolts.

26. A heat shield according to claim 1, said heat shield consisting essentially of said two metal layers and said layer of sound and heat shielding material.

27. A heat shield according to claim 8, wherein said ceramic fiber material is ceramic fiber paper.

28. A heat shield according to claim 27, wherein one of said stainless steel metal layers is about 0.008 inch thick.

29. A heat shield according to claim 2, wherein one of said two metal layers is stainless steel and is adapted to be adjacent to said high temperature portion of said exhaust system, and the other of said two metal layers is aluminized steel.

30. A heat shield according to claim 29, wherein said layer of aluminum is about 0.001 inch thick.

31. A heat shield according to claim 30, wherein said stainless steel metal layer is about 0.006 inch thick.

32. A heat shield according to claim 29, wherein said high temperature portion of said exhaust system is an exhaust manifold.

33. A heat shield according to claim 5, wherein each of said two metal layers is aluminized steel.

34. A heat shield according to claim 2, wherein each of said two metal layers is steel, and the exterior surface of said shield is coated with a coating effective to provide corrosion-resistant protection to the heat shield.

35. A heat shield according to claim 34, wherein said coating is high temperature resistant.

36. A heat shield according to claim 7, wherein each of said two metal layers is steel, and the exterior surface of said shield is coated with a coating effective to provide corrosion-resistant protection to the heat shield.

37. A heat shield according to claim 36, wherein said coating is high temperature resistant.

38. A heat shield according to claim 1, wherein each of said two metal layers is aluminum.

39. A heat shield according to claim 2, wherein each of said two metal layers is aluminum.

40. A heat shield according to claim 39, wherein said layer of aluminum positioned between said two metal layers is about 0.001 inch thick.

41. A heat shield according to claim 38, wherein said first predetermined thickness is 0.010–0.012 inches thick and said second predetermined thickness is 0.007–0.009 inches thick.

42. A heat shield according to claim 1, wherein one of said metal layers has a non-planar shape and wherein the other of said metal layers and the layer of sound and heat shielding material both conform to said non-planar shape.

43. A heat shield according to claim 1, wherein said sound and heat shielding material is fibrous heat shielding material.

* * * * *

UNITED STATES PATENT AND TRADEMARK OFFICE

CERTIFICATE OF CORRECTION

PATENT NO. : 5,590,524

DATED : January 7, 1997

INVENTOR(S) : Dan T. Moore, III, et al.

It is certified that error appears in the above-indentified patent and that said Letters Patent is hereby corrected as shown below:

In column 10, line 2 delete "end" and insert --and--

In claim 22, column 12, line 1 delete "of" (second occurence) and insert --to--

Signed and Sealed this

Eighth Day of April, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,590,524
APPLICATION NO. : 08/258962
DATED : January 7, 1997
INVENTOR(S) : Dan T. Moore, III, Austin W. Moore and Maurice E. Wheeler It is certified that error appears in the above-identified patent and that said Letters Patent is hereby corrected as shown below:

On the Title Page, left-hand column, after "Notice:" delete

"The portion of the term of this patent subsequent to Aug. 10, 2010, has been disclaimed."

and insert therefor the following:

-- The term of this patent has been disclaimed to the extent it extends beyond the full statutory term of U.S. Patent No. 5,233,832. --

Signed and Sealed this

Twenty-sixth Day of August, 2008

JON W. DUDAS
*Director of the United States Patent and Trademark Office*